US006635227B1

(12) United States Patent
Shibata et al.

(10) Patent No.: US 6,635,227 B1
(45) Date of Patent: Oct. 21, 2003

(54) CATALYTIC CONVERTER

(75) Inventors: Katsuhiro Shibata, Tokyo (JP); Kimiyoshi Nishizawa, Yokohama (JP); Ken Oouchi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/527,463

(22) Filed: Mar. 17, 2000

(30) Foreign Application Priority Data

Mar. 18, 1999 (JP) ..... 11-073466

(51) Int. Cl.[7] ..... B01D 53/34; F01N 3/28
(52) U.S. Cl. ..... 422/179; 422/177; 422/180
(58) Field of Search ..... 422/171, 177, 422/179, 180

(56) References Cited

U.S. PATENT DOCUMENTS

| | | | | |
|---|---|---|---|---|
| 4,142,864 A | * | 3/1979 | Rosynsky et al. | 422/179 |
| 4,347,219 A | | 8/1982 | Noritake et al. | 422/180 |
| 4,396,664 A | * | 8/1983 | Mochida et al. | 422/180 |
| 4,397,817 A | * | 8/1983 | Otani et al. | 422/179 |
| 5,555,621 A | | 9/1996 | Tanabe et al. | 29/890 |

FOREIGN PATENT DOCUMENTS

JP 7-317537 12/1995

* cited by examiner

*Primary Examiner*—Hien Tran
(74) *Attorney, Agent, or Firm*—Foley & Lardner

(57) ABSTRACT

A catalytic converter for purifying exhaust gas discharged from an automotive internal combustion engine. The catalytic converter comprises a casing in which a monolithic catalyst carrier is disposed. An annular cap is fixedly disposed inside the casing and located generally coaxial with the monolithic catalyst carrier. The annular cap is located near an end face of the monolithic catalyst carrier. The cap includes annular bottom, inner and outer walls. The inner and outer walls are separate from each other and extend from the bottom wall. The inner wall is located radially inward of the outer wall. The bottom, inner and outer walls are arranged generally U-shaped in cross-section so as to form a groove. Additionally, an annular elastic washer is coaxially disposed within the groove of the annular cap. The elastic washer is disposed in press contact with the end face of the monolithic catalyst carrier to axially elastically support the monolithic catalyst carrier. The annular elastic washer is an annular molded structure of wire mesh. The annular elastic washer has an inner peripheral face which has a diameter larger than a diameter of an outer peripheral surface of the inner wall of the cap so as to form a clearance between the elastic washer and the inner wall of the cap in a state where the elastic washer is assembled in the casing upon being compressed.

7 Claims, 5 Drawing Sheets

CATALYTIC CONVERTER

BACKGROUND OF THE INVENTION

This invention relates to improvements in a catalytic converter having a monolithic catalyst carrier so as to purify exhaust gas from an internal combustion engine, and more particularly to improvements in a catalyst carrier supporting device having an elastic washer to be used to axially elastically support the monolithic catalyst carrier in a casing of the catalytic converter.

Most automotive vehicles are equipped with a catalytic converter for the purpose of purifying exhaust gas discharged from an internal combustion engine. For example, the catalytic converter is constructed such that a monolithic catalyst carrier is encased within a casing including a part of an exhaust manifold. The monolithic catalyst carrier formed of ceramic is brittle and tends to be readily damaged, and therefore it is required to be elastically supported within the casing. Specifically, as disclosed in Japanese Patent Provisional Publication No. 7-317537, a cylindrical supporting member formed of a corrugated cylindrical wire mesh structure is disposed around the monolithic catalyst carrier so as to radially elastically support the monolithic catalyst carrier. Additionally, annular elastic washers formed of an annular wire mesh structure are disposed respectively in press contact with the outer peripheral portions of the opposite end faces of the monolithic catalyst carrier so as to axially elastically support the monolithic catalyst carrier.

Each elastic washer is produced by first weaving an annular structure of wire mesh so as to possess a suitable rigidity and then by forcing the wire mesh annular structure into a mold having a certain shape so that the wire mesh annular structure has a rectangular cross-section. The thus produced elastic washer is located in the casing such that a part of the elastic washer projects radially outward of the outer peripheral surface of the monolithic catalyst carrier. In other words, the elastic washer is located to extend radially inward and outward of the outer peripheral surface of the monolithic catalyst carrier. In an assembled state of the catalytic converter in which the casing is tightly closed with bolts or the like, the elastic washer is in a condition to be compressed by a certain amount. Additionally, the elastic washer is usually supported by an annular metal member having an inner peripheral wall to be located along the inner peripheral surface of the elastic washer. For example, in an arrangement disclosed in the above-mentioned Japanese Patent Provisional Publication, an annular metallic carrier supporting plate is provided to retain the elastic washer in a manner to cause the elastic washer to be in press contact with an end face of the monolithic catalyst. Additionally, the elastic washer is positioned between an annular inner peripheral wall of the carrier supporting plate and an inner peripheral portion of the casing.

Besides, the following structure has been put into practical use: The above-mentioned metallic carrier supporting plate is replaced with an annular cap including annular inner and outer peripheral walls and an annular bottom wall so as to have a generally U-shaped cross-section. Thus, this annular cap is formed with an annular groove in which the annular elastic washer is fitted to be retained there.

Under the action of such carrier supporting plate and cap, the elastic washer is positioned at a certain location while being protected from oxidation with high temperature exhaust gas though the elastic washer is formed of the wire mesh.

SUMMARY OF THE INVENTION

In connection with the catalytic converter having the above-discussed structure which has been put into practical use, the monolithic catalyst carrier formed of ceramic has a plurality of cells extending from its upstream-side end face to its downstream-side end face. Each cell is defined by walls having a thickness of several mil (1/1000 inch). Accordingly, the walls of the cells tend to readily damaged, in which the wall located at the outer-most peripheral portion particularly tends to be readily peeled off by a slight external force.

During operation of the catalytic converter, the metallic carrier supporting plate with the elastic washer is repeatedly radially displaced upon repetition of thermal expansion and contraction although the monolithic catalyst carrier hardly makes its thermal expansion and contraction. Consequently, the elastic washer is radially outwardly displaced upon thermal expansion of the carrier supporting plate under operation of the engine, thereby radially outwardly pulling the outer peripheral portion of the monolithic catalyst carrier at the end face. This causes the outer peripheral portion at the end face of the monolithic catalyst to be peeled off.

Thus, the outer peripheral portion of the monolithic catalyst carrier at the end face tends to be readily peeled off and damaged. If the outer peripheral portion is once broken off, an axial free movement of the monolithic catalyst carrier becomes large, and therefore total damage of the monolithic catalyst carrier abruptly progresses under vibration or the like during vehicle cruising.

It is, therefore, an object of the present invention to provide an improved catalytic converter which can effectively overcome drawbacks encountered in conventional catalytic converters.

Another object of the present invention is to provide an improved catalytic converter in which a monolithic catalyst carrier in a casing can be effectively protected from being damaged in its outer peripheral portion at an end face.

A further object of the present invention is to provide an improved catalytic converter in which an outer peripheral portion of a monolithic catalyst carrier at the end face can be effectively prevented from being radially outwardly pulled by an elastic washer which is in press contact with the outer peripheral portion of the monolithic catalyst carrier.

A still further object of the present invention is to provide an improved catalytic converter in which an elastic washer retained by a metallic cap can be prevented from being radially outwardly displaced even upon radially outward displacement of the cap owing to thermal expansion of the cap.

A catalytic converter according to the present invention comprises a casing. A monolithic catalyst carrier is disposed inside the casing. An annular cap is fixedly disposed inside the casing and located generally coaxial with the monolithic catalyst carrier. The annular cap is located near an end face of the monolithic catalyst carrier. The cap includes annular bottom, inner and outer walls. The inner and outer walls are separate from each other and extend from the bottom wall. The inner wall is located radially inward of the outer wall. The bottom, inner and outer walls are arranged generally U-shaped in cross-section so as to form a groove. Additionally, an annular elastic washer is coaxially disposed within the groove of the annular cap. The elastic washer is disposed in press contact with the end face of the monolithic catalyst carrier to axially elastically support the monolithic catalyst carrier. The annular elastic washer is an annular molded structure of wire mesh. The annular elastic washer has an inner peripheral face which has a diameter larger than a diameter of an outer peripheral surface of the inner wall of the cap so as to form a clearance between the elastic washer and the inner wall of the cap in a state where the elastic washer is assembled in the casing upon being compressed.

BRIEF DESCRIPTION OF THE DRAWINGS

In the drawings, like reference numerals designate like parts and elements throughout all figures, in which.

DETAILED DESCRIPTION OF THE INVENTION

Figure 1:
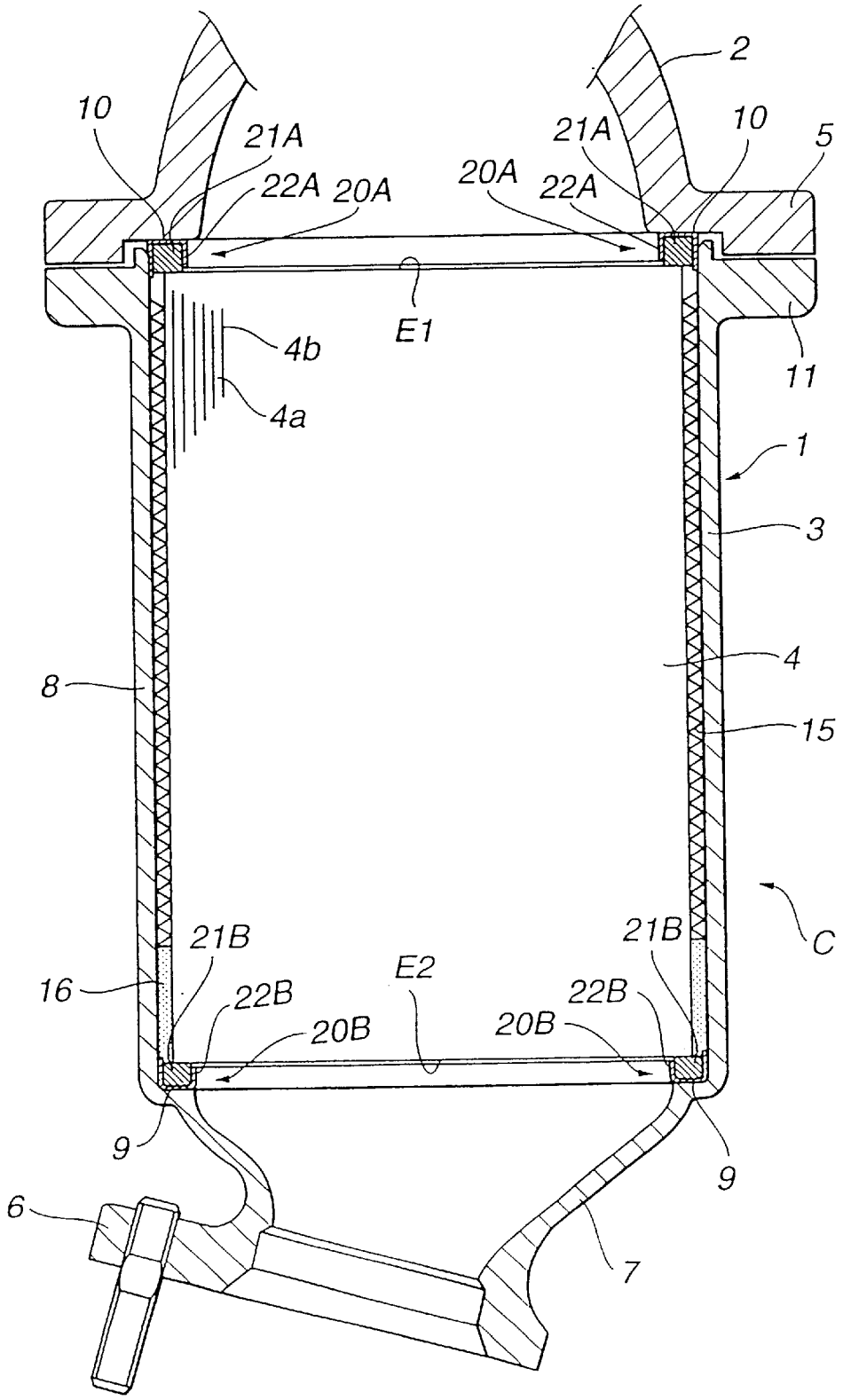
FIG. 1 is a longitudinal sectional view of a first embodiment of a catalytic converter according to the present invention.

Referring to FIG. 1, a first embodiment of a catalytic converter according to the present invention is illustrated by the reference character C. The catalytic converter C is connected to an outlet section 2 of an exhaust manifold of an internal combustion engine of an automotive vehicle. The catalytic converter C comprises a casing 1 which is constituted of the exhaust manifold outlet section 2 and a generally cylindrical container 3. The exhaust manifold outlet section 2 has an outlet flange section 5 to which the cylindrical container 3 is fixedly and sealingly connected. The container 3 includes a cylindrical section 8 inside which a cylindrical monolithic catalyst carrier 4 formed of ceramic is disposed. The container 3 further includes a generally frustoconical hollow section 7 which is integrally provided with a flange section 6 to which an exhaust pipe or front tube (not shown) is connected. The cylindrical monolithic catalyst carrier 4 has a plurality of gas passages 4*a* which axially extend from an upstream-side end face E1 to a downstream-side end face E2 of the monolithic catalyst carrier 4. Each gas passage 4*a* is defined by thin walls 4*b* of ceramic, in which each thin wall 4*b* has a thickness of not larger than 5 mil. The thin walls carry catalyst or catalytic component.

The cylindrical section 8 of the container 3 has a constant inner diameter throughout a whole axial length. An annular step portion or flat support face 9 is formed between the cylindrical section 8 and the frustoconical hollow section 7 so as to position a downstream-side end section (including the downstream-side end face E2) of the monolithic catalyst carrier 4. The flat support face 9 is perpendicular to an axis of the cylindrical section 8. Similarly, an annular step portion or flat support face 10 is formed radially inward of the outlet flange section 5 of exhaust manifold outlet section 2 so as to position an upstream-side end section (having the upstream-side end face E1) monolithic catalyst carrier 4. The annular flat support face 10 is perpendicular to the axis of the cylindrical section 8. As shown, the upstream-side and downstream-side end faces E1, E2, of the monolithic catalyst carrier 4 are spaced respectively from the annular flat support faces 10, 9. The cylindrical section 8 is integrally provided with an annular flange section 11 which radially outwardly extends and is located near an upstream-side end section of the cylindrical section 8. The cylindrical section 8 is connected and fastened to the outlet flange section 5 of the exhaust manifold 2 by a plurality of bolts (not shown).

The cylindrical section 8 of the container 3 has an inner diameter slightly larger than an outer diameter of the monolithic catalyst carrier 4 so as to define an annular clearance or space between the inner peripheral surface of the cylindrical section 8 and the outer peripheral surface of the monolithic catalyst carrier 4. An annular support member 15 is disposed in the annular space and formed of a cushion material which is produced by first forming a cylindrical structure of wire mesh of relatively thick wires and then by bending the wire mesh cylindrical structure to have corrugations. The annular support member or wire mesh cylindrical structure 15 is installed to cover the outer cylindrical surface of the monolithic catalyst carrier 4. The annular support member 15 has an axial length slightly smaller than the whole length of the monolithic catalyst carrier 4. A cylindrical noncombustible mat 16 is disposed in the space between the inner peripheral surface of the cylindrical section 8 of the container 3 and the peripheral surface of the monolithic catalyst carrier 4, and located at a downstream-side of the annular support member 15. The noncombustible mat 16 is produced by forming noncombustible fiber into the mat-shape and functions mainly to make a gas-tight seal for the annular space formed between the inner peripheral surface of the cylindrical section 8 and the outer peripheral surface of the monolithic catalyst carrier 4 thereby preventing exhaust gas from flowing through the support member 15. The noncombustible mat 16 is available from Minnesota Mining & Mfg. (3M Company) under the trade name of "Interam-mat".

An annular catalyst carrier supporting device 20A is disposed between the upstream-side end face E1 of the monolithic catalyst carrier 4 and the annular flat support face 10 of the exhaust manifold outlet section 2 so as to axially elastically support the monolithic catalyst carrier 4. The catalyst carrier supporting device 20A includes an annular elastic washer 21A which is disposed in a groove formed in an annular cap 22A. The annular elastic washer 21A and the cap 22A are substantially coaxial with the cylindrical section 8 of the container 3. Similarly, another annular catalyst carrier supporting device 20B is disposed between the downstream-side end face E2 of the monolithic catalyst carrier 4 and the annular flat support face 9 of the container 3 so as to axially elastically support the monolithic catalyst carrier 4. The catalyst carrier supporting device 20B includes an annular elastic washer 21B which is disposed in an annular cap 22B. The annular elastic washer 21B and the cap 22B are substantially coaxial with the cylindrical section 8 of the container 3. The catalyst carrier supporting devices 20A, 20B are substantially the same in structure and material as each other; however they may be slightly different in structure and material from each other.

While only the catalyst carrier supporting device 20B will be discussed in detail hereafter with reference to FIGS. 2 to 6, discussion of the catalyst carrier supporting device 20A will be omitted for the sake of simplicity of illustration since the supporting device 20A is substantially the same as the supporting device 20B as described above.

Figure 2:
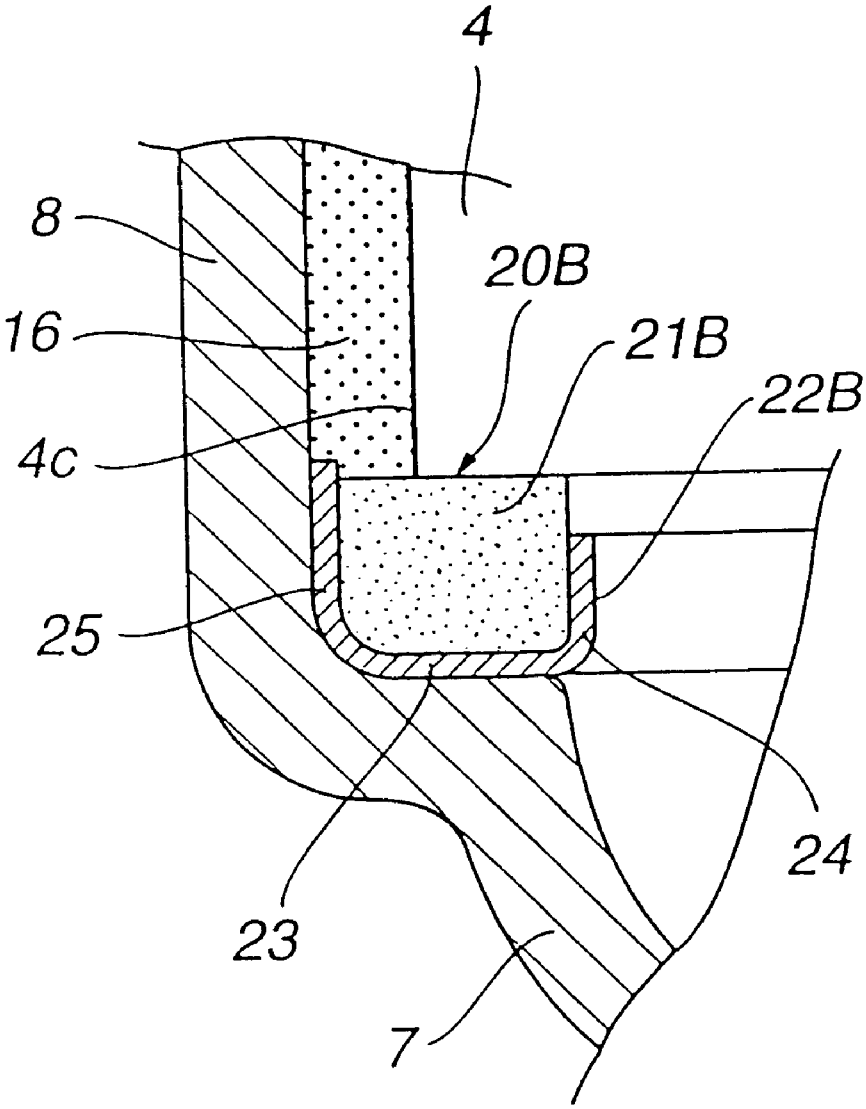
FIG. 2 is a fragmentary enlarged sectional view of an essential part of the catalytic carrier of FIG. 1.
Figure 3:
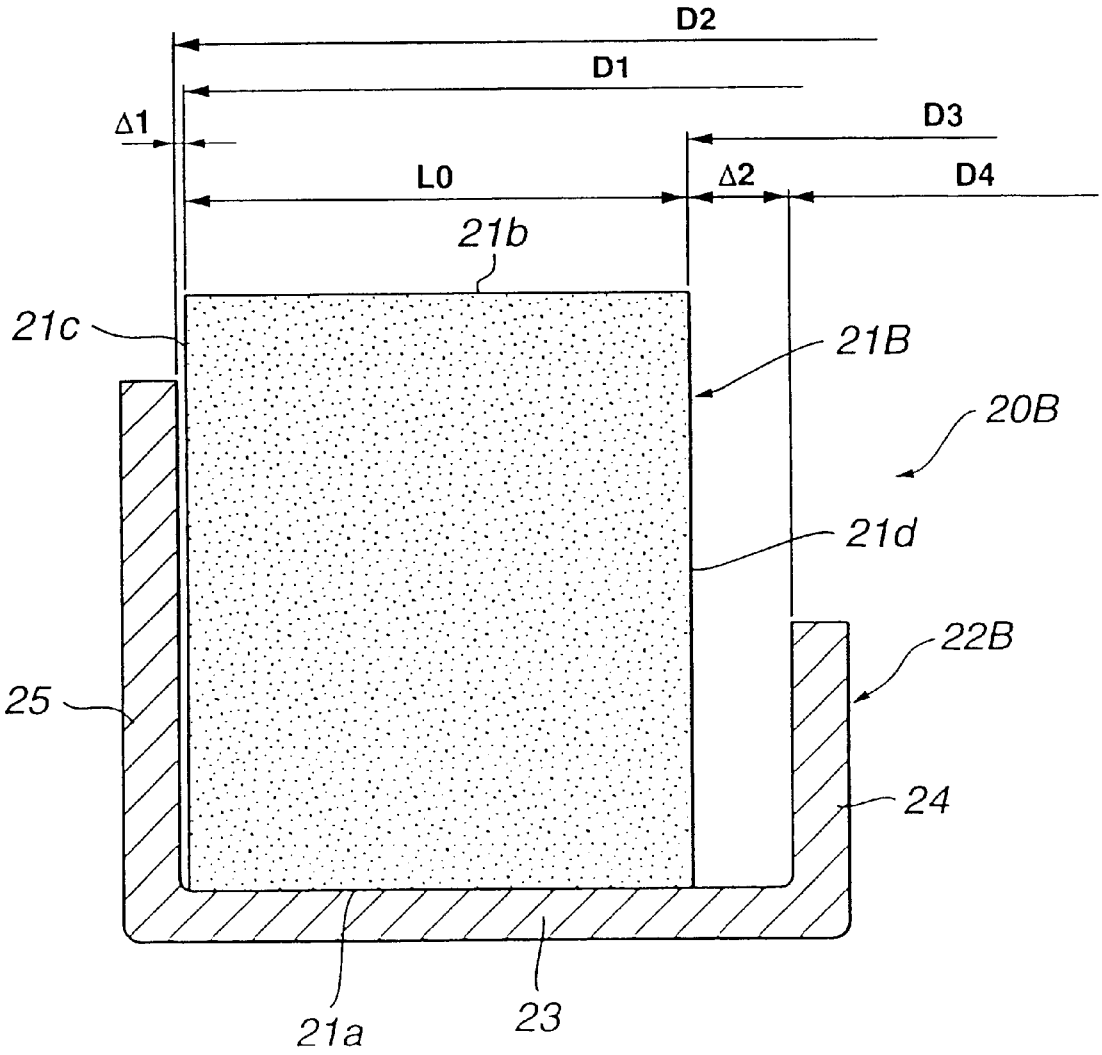
FIG. 3 is an enlarged sectional view of an essential part of the catalytic converter of FIG. 1, showing a locational relationship between an elastic washer and a cap in a state where the elastic washer is not compressed.

As shown in FIGS. 2 and 3, the cap 22B includes an annular bottom wall 23 which is in contact with the annular support face 9. Annular inner and outer walls 24, 25 extend respectively from the inner and outer peripheral portions of the annular bottom wall 23. The annular inner and outer walls 24, 25 are integral with and perpendicular to the annular bottom wall 23, so that the cap 22B has the generally U-shaped cross-section to define the annular groove for coaxially receiving the annular elastic washer 21B. The annular inner wall 24 is located slightly radially inward of the outer peripheral surface 4*c* of the monolithic catalyst carrier 4. The annular outer wall 25 is located slightly radially outward of the outer peripheral surface 4*c* of the monolithic catalyst carrier 4. The annular inner wall 24 has a relatively small axial length so that its tip end is separate from the downstream-side end face E2 of the monolithic catalyst carrier 4. The annular outer wall 25 has a larger axial length than the annular inner wall 24 so as to extend beyond the downstream-side end face E2 of the monolithic catalyst carrier 4 and have a tip end located over the outer peripheral surface of the monolithic catalyst carrier 4. The cap 22B is formed, for example, of a sheet of ferritic stainless steel having a low coefficient of thermal expansion. An example of such ferritic stainless steel is identified as SUS 430 (according to Japanese Industrial Standard).

The elastic washer 21B is produced by first forming a generally annular wire mesh structure and then by forcing the annular wire mesh structure into a mold having a certain shape so as to have the generally rectangular cross-section as shown FIG. 3. The thus produced elastic washer 21B is located within a groove (not identified) formed between the inner and outer walls 24, 25 of the cap 22B. The elastic washer 21B is located such that an annular radially outward part thereof extends radially outward of the outer peripheral surface 4*c* of the monolithic catalyst carrier 4. In other words, the elastic washer 21B is located to extend radially inward and radially outward of the outer peripheral surface 4*c* of the monolithic catalyst 4. In an assembled state of the catalytic converter C where the flange section 11 of the container 3 is fastened to the flange section 3 of the exhaust manifold outlet section 2, the elastic washer 21B is axially compressed by a certain amount.

FIG. 3 shows a specific locational relationship between the elastic washer 21B and the cap 22B of the catalyst carrier supporting device 20B, in a state where the elastic washer 21B is not compressed, obtained before assembly of the catalyst carrier supporting device 20B in the catalytic converter C. The elastic washer 21B in this embodiment is annular and has a rectangular cross-section whose axial dimension is larger than its radial dimension. The elastic washer 21B has an annular flat bottom face 21*a*, an annular flat top face 21*b*, a cylindrical outer peripheral face 21*c* and a cylindrical inner peripheral face 21*d*. The flat bottom face 21*a* and the flat top face 21*b* are parallel with each other. The cylindrical outer peripheral face 21*c* and the cylindrical inner peripheral face 21*d* are coaxial with each other. The cylindrical outer peripheral face 21*c* is coaxial with the inner peripheral surface of the outer wall 25 and slightly separate from the inner peripheral surface of the outer wall 25, in which the diameter D1 of the cylindrical outer peripheral face 21*c* of the elastic washer 21B is set slightly smaller than the diameter D2 of the inner peripheral surface of the outer wall 25 of the cap 22B so as to form a slight clearance Δ1. This clearance Δ1 serves to absorb a production tolerance and is set as small as possible within a range where assembly of the catalytic converter cannot be difficult. Additionally, the cylindrical inner peripheral face 21*d* of the elastic washer 21B is generally coaxial with the inner peripheral surface of the inner wall 24 and separate from the inner peripheral surface of the inner wall 24, in which the diameter D3 of the cylindrical inner peripheral face 21*d* of the elastic washer 21B is set larger than the inner peripheral surface of the inner wall 24 so as to form a relatively large clearance Δ2. This clearance Δ2 is set to absorb displacement of the inner wall 24 due to thermal expansion of the cap 22B. Particularly, setting is made such that a difference (Δ2−Δ1) between the clearance Δ2 and the clearance Δ1 corresponding to the tolerance becomes larger than a radial displacement amount of the inner wall 24 due to thermal expansion of the cap 22B. By virtue of such setting, the actual radial amount of the clearance Δ2 cannot be smaller than the radial displacement amount of the inner wall 24 under thermal expansion.

The difference between the clearance Δ2 and the clearance Δ1 may be not less than 0.5% of the diameter of the inner wall 24 of the cap 22B, for example.

Concrete examples of the dimensions of the catalyst carrier supporting device 20B are as follows: The clearance Δ1 is 0.1 mm; the clearance Δ2 is 1.2 mm; the radial width L0 of the elastic washer 21 is 6 mm; and the diameter D4 of the outer peripheral surface of the inner wall 24 is 83 mm. Additionally, the coefficient of thermal expansion of SUS 430 (ferritic stainless steel) is about 11.9 (cm/cm° C.$\times 10^{-6}$) under a condition where temperature of the SUS 430 rises from 0° C. to 700° C. In this connection, an austenitic stainless steel identified as SUS 310S (according to Japanese Industrial Standard) has a coefficient of thermal expansion of about 17.8 (cm/cm° C.$\times 10^{-6}$).

The elastic washer 21B is axially compressed by a certain amount in the assembled state in the catalytic converter C, so that the monolithic catalyst carrier 4 can be elastically axially supported under the reaction of the axial compression of the elastic washer 21B, preventing the monolithic catalyst carrier 4 from being axially displaced. In this regard, the dimensions of the parts of the catalytic converter C are set such that the elastic washer 21B is axially compressed to have a compressibility (a rate of a deformation amount under compression relative to an original dimension) of not larger than 50%, preferably about 40%.

With the above embodiment of the catalytic converter C, even in the assembled state where the elastic washer 21 was compressed and deformed, a clearance having a radial dimension larger than or generally corresponding to the radial displacement amount of the inner wall 24 can be ensured between the cylindrical inner peripheral face 21*d* of the elastic washer 21B and the outer peripheral surface of the inner wall 24 of the cap 22B. Accordingly, even when the cap 22B radially expands under its thermal expansion, the elastic washer 21B cannot be pressed radially outwardly by the inner wall 24 of the cap 22B, and therefore the annular flat top face 21*b* of the elastic washer 21B cannot radially outwardly pull an outer peripheral portion (around the outer peripheral surface 4*c*) of the monolithic catalyst carrier 4 at the end face E2. This effectively prevents the outer peripheral portion of the monolithic catalyst carrier 4 from being peeled off and damaged.

In this embodiment, the cap 22A of the catalyst carrier supporting device 20A is substantially the same as the cap 22B of the catalyst carrier supporting device 20B and includes the annular bottom wall 23, and the annular inner and outer walls 24, 25, though not shown. Additionally, the annular elastic washer 21A of the catalyst carrier supporting device 20A is substantially the same as the annular elastic washer 21B of the catalyst carrier supporting device 20B, though not shown. Therefore, while the specific locational relationship between the elastic washer 21B and the cap 22B and the function thereof only in the catalyst carrier supporting device 20B have been shown and described, it will be understood that the specific locational relationship between the elastic washer 21A and the cap 22A and the function thereof in the catalyst carrier supporting device 20A are substantially the same as those of the catalyst carrier supporting device 20B.

Figure 4:
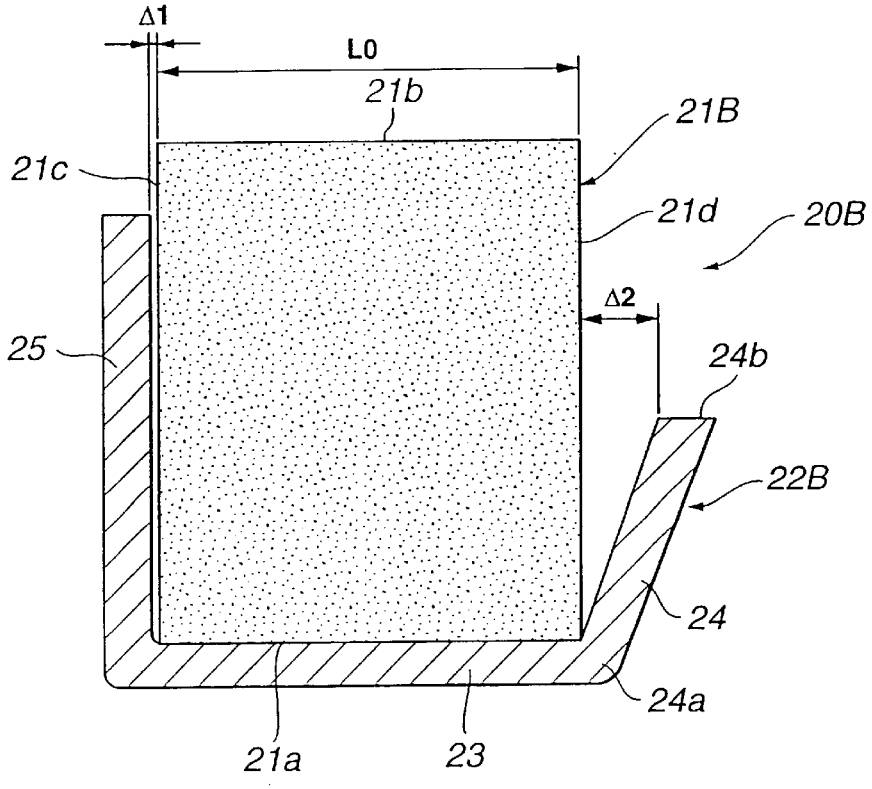
FIG. 4 is an enlarged sectional view similar to FIG. 3, but showing an essential part of a second embodiment of the catalytic converter according to the present invention.

FIG. 4 illustrates an essential part of a second embodiment of the catalytic converter C according to the present invention, which is similar to that of the first embodiment. In this embodiment, the annular inner wall 24 of the cap 22B is generally frustoconical, and therefore an annular tip end section 24*b* of the inner wall 24 is located radially inward relative to an annular bottom end section 24*a* at which the inner wall 24 is integrally connected to the annular bottom wall 23. In this embodiment, the annular bottom end section 24*a* is located radially outward relative to the corresponding section in the first embodiment. As a result, the tip end section 24*b* of the inner wall 24 is considerably separate from the cylindrical inner peripheral face 21*d* of the elastic washer 21B so as to form a clearance Δ2 between the tip end section 24*b* and the cylindrical inner peripheral face 21*d* similarly to in the first embodiment. A concrete example of the clearance Δ1 is 0.1 mm while a concrete example of the clearance Δ2 is 1.2 mm as same as in the first embodiment.

In this embodiment, the radial width of the bottom wall 23 of the cap 22B becomes similar to the radial width L0 of the elastic washer 21B, and therefore the elastic washer 21B can be accurately positioned within the cap 22B while the elastic washer 21B (particularly at a top face section including the top face 21*b*) can be prevented from being pressed radially outwardly even under the thermal expansion of the cap 22B similarly to in the first embodiment.

Figure 5:
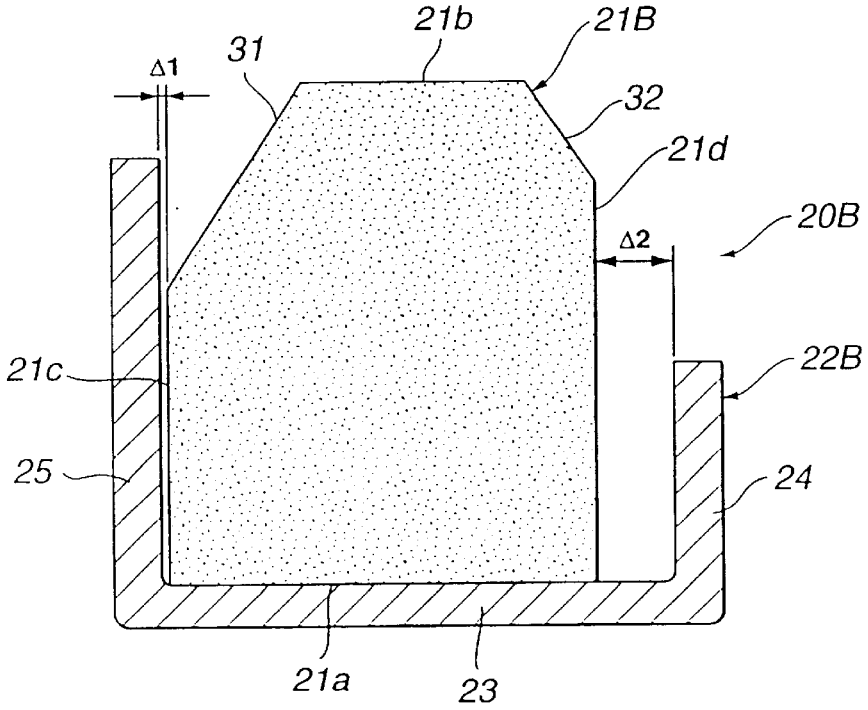
FIG. 5 is an enlarged sectional view similar to FIG. 3, but showing an essential part of a third embodiment of the catalytic converter according to the present invention.

FIG. 5 illustrates an essential part (the catalyst carrier supporting device 20B) of a third embodiment of the catalytic converter C according to the present invention, similar to that of FIG. 3 of the first embodiment. In this embodiment, a first annular chamfer 31 is formed in a manner to connect the annular flat top face 21*b* and the cylindrical outer peripheral face 21*c* of the elastic washer 21B. The first annular chamfer 31 is located radially outward of the outer peripheral surface 4*c* of the monolithic catalyst carrier 4 so that the outer peripheral surface 4*c* of the monolithic catalyst carrier 4 is generally coincident with the outer periphery of the top face 21*b* of the elastic washer 21B. Additionally, a second annular chamfer 32 is formed in a manner to connect the annular flat top face 21*b* and the cylindrical inner peripheral face 21*d* of the elastic washer 21B. The second annular chamfer 32 is smaller in radial width than the first annular chamfer 31.

Similarly to the first embodiment, the relatively small clearance Δ1 is formed between the cylindrical outer peripheral face 21*c* of the elastic washer 21B and the inner peripheral surface of the outer wall 25 of the cap 22B. Additionally, the relatively large clearance Δ2 is formed between the cylindrical inner peripheral face 21*d* of the elastic washer 21B and the inner peripheral surface of the inner wall 24 of the cap 22B. The clearances Δ1, Δ2 are the same in dimension as those in the first and second embodiment.

In this embodiment, a top portion (including the top face 21*b*) of the elastic washer 21B takes the generally trapezoidal shape in cross-section, and therefore the whole elastic washer 21B can be prevented from deforming in a manner to fall down when the elastic washer 21B is compressed in its assembled state. This makes it possible to further stably support the monolithic catalyst carrier 21B. More specifically, the first annular chamfer 31 formed at the radially outward side of the elastic washer 21B prevents a portion of the elastic washer 21B from projecting radially outward of the outer peripheral surface 4*c* of the monolithic catalyst carrier 4 even in the assembled state where the elastic washer 21B is compressed and deformed. This prevents the portion of the elastic washer 21B from lapping over the outer peripheral surface 4*c* of the monolithic catalyst carrier 4 thereby reducing a load applied around an end edge (including the end part of the outer peripheral surface 4*c*) of the monolithic catalyst carrier 4. Thus, according to this embodiment, the monolithic catalyst carrier 4 at the portion around the end edge can be further securely prevented from being peeled off and damaged even under repetition of thermal expansion of the cap 22B. Additionally, the second annular chamfer 32 can prevent a portion of the elastic washer 21B from projecting radially inward of the inner wall 24 of the cap 22B, thus effectively avoiding oxidation of the elastic washer 21B upon contact of the portion of the elastic washer 21B with exhaust gas.

Figure 6:
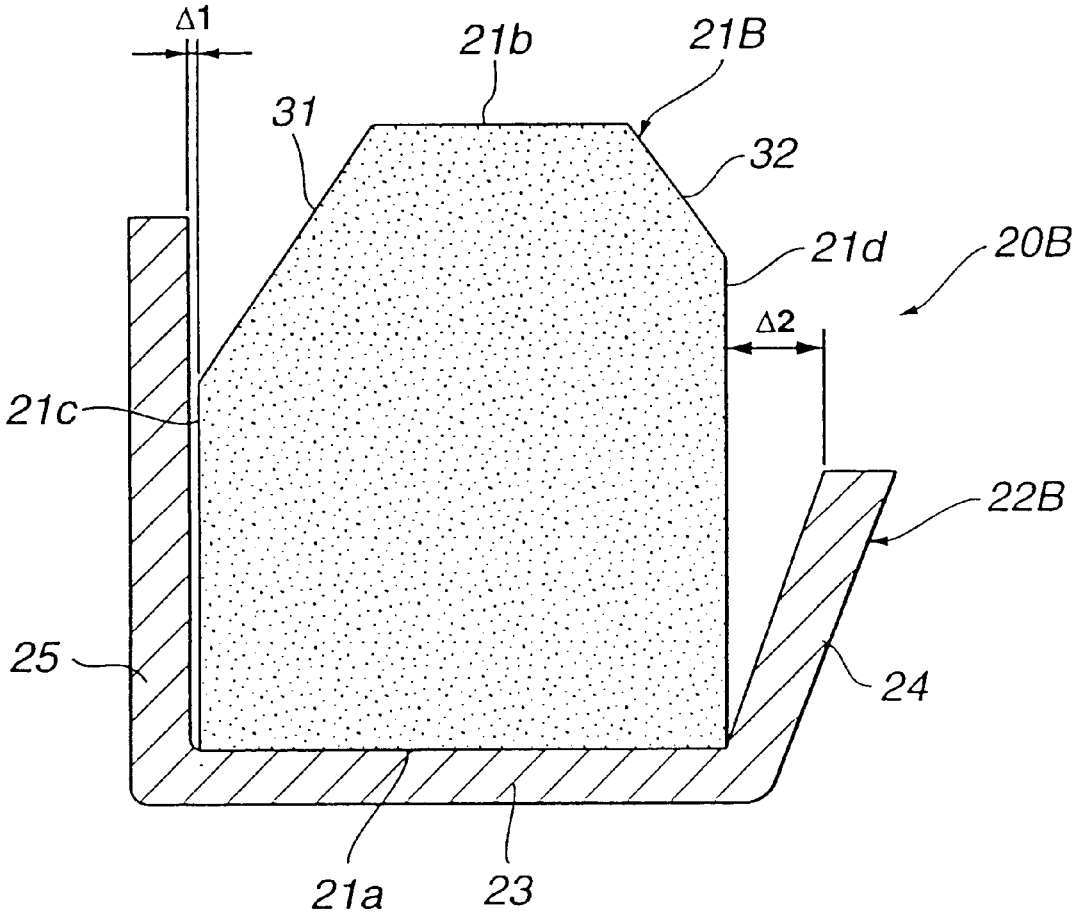
FIG. 6 is an enlarged sectional view similar to FIG. 3, but showing an essential part of a fourth embodiment of the catalytic converter according to the present invention.

FIG. 6 illustrates an essential part (the catalyst carrier supporting device 20B) of a fourth embodiment of the catalytic converter C according to the present invention, similar to that of FIG. 4 of the second embodiment. In this embodiment, similarly to the third embodiment, the first annular chamfer 31 is formed in a manner to connect the annular flat top face 21*b* and the cylindrical outer peripheral face 21*c* of the elastic washer 21B. The first annular chamfer 31 is located radially outward of the outer peripheral surface 4*c* of the monolithic catalyst carrier 4 so that the outer peripheral surface 4*c* of the monolithic catalyst carrier 4 is generally coincident with the outer periphery of the top face 21*b* of the elastic washer 21B. Additionally, the second annular chamfer 32 is formed in a manner to connect the annular flat top face 21*b* and the cylindrical inner peripheral face 21*d* of the elastic washer 21B. The second annular chamfer 32 is smaller in radial width than the first annular chamfer 31.

It will be understood that the catalyst carrier supporting device 20B of this embodiment functions similarly to that of the third embodiment.

As appreciated from the above, with the catalytic converter according to the present invention, when the temperature of the catalytic converter becomes high with operation of the internal combustion engine, the cap formed of metal thermally expands to make its radially outward expansion while the monolithic catalytic carrier formed of ceramic hardly thermally expands, in which the elastic washer itself is very small in radially outward expansion because of being formed of wire mesh. Even under such circumstance, since the clearance has been previously provided between the inner wall of the cap and the inner peripheral face of the elastic washer, a force acting from the inner wall of the cap to radially outwardly displace the elastic washer can be lowered, thereby weakening a radially outward force to be applied to the outer peripheral portion of the monolithic catalyst carrier at the end face. As a result, the outer peripheral portion of the monolithic catalyst carrier can be effectively protected from being peeled off and damaged.

The entire contents of Japanese Patent Applications P11-73466 (filed Mar. 18, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A catalytic converter comprising:

a casing;

a monolithic catalyst carrier disposed inside said casing;

an annular cap fixedly disposed inside said casing and located generally coaxial with said monolithic catalyst carrier, said annular cap being located adjacent an end face of said monolithic catalyst carrier, said cap including annular bottom, inner and outer walls, the inner and outer walls being separate from each other and extending from the bottom wall, the inner wall being located radially inward of the outer wall, the bottom, inner and outer walls being arranged generally U-shaped in cross-section so as to form a groove; and an annular elastic washer coaxially disposed within the groove of said annular cap, said elastic washer being disposed in press contact with the end face of said monolithic catalyst carrier to axially elastically support said monolithic catalyst carrier, said annular elastic washer being an annular molded structure of wire mesh, said annular elastic washer having an inner peripheral face which has a diameter larger than a diameter of an outer peripheral surface of the inner wall of said cap so as to form an inner clearance between said elastic washer and the inner wall of said cap in a state where said elastic washer is assembled in said casing upon being compressed.

2. A catalytic converter as claimed in claim 1, wherein the clearance generally corresponds to a radial displacement amount of the inner wall of said cap upon thermal expansion of said cap.

3. A catalytic converter as claimed in claim 1, wherein the inner wall of said cap is generally cylindrical and coaxial with said casing.

4. A catalytic converter as claimed in claim 1, wherein the inner wall of said cap is generally frustoconical and has a first diameter defined by an annular tip end section of the inner wall and a second diameter defined by an annular bottom end section of the inner wall, the annular bottom end section being connected to the bottom wall of said cap, the first diameter being smaller than the second diameter.

5. A catalytic converter as claimed in claim 1, wherein said monolithic catalyst carrier has a plurality of axially extending passages through which gas flows, each passage being defined by walls having a thickness of not larger than 5 mil.

6. A catalytic converter comprising:

a casing;

a monolithic catalyst carrier disposed inside said casing;

an annular cap fixedly disposed inside said casing and located generally coaxial with said monolithic catalyst carrier, said annular cap being located adjacent an end face of said monolithic catalyst carrier, said cap including annular bottom, inner and outer walls, the inner and outer walls being separate from each other and extending from the bottom wall, the inner wall being located radially inward of the outer wall, the bottom, inner and outer walls being arranged generally U-shaped in cross-section so as to form a groove; and an annular elastic washer coaxially disposed within the groove of said annular cap, said elastic washer being disposed in press contact with the end face of said monolithic catalyst carrier to axially elastically support said monolithic catalyst carrier, said annular elastic washer being an annular molded structure of wire mesh, said annular elastic washer having an inner peripheral face which has a diameter larger than a diameter of an outer peripheral surface of the inner wall of said cap so as to form an inner clearance between said elastic washer and the inner wall of said cap in a state where said elastic washer is assembled in said casing upon being compressed, wherein said annular elastic washer has an outer peripheral face which has a diameter smaller than a diameter of an inner peripheral surface of the outer wall of said cap so as to form an outer clearance to absorb a tolerance between said elastic washer and the outer wall of said cap in a state where said elastic washer is not assembled in said casing; wherein said annular elastic washer has the inner peripheral face which has a diameter larger than a diameter of the outer peripheral surface of the inner wall of said cap so as to form the inner clearance between said elastic washer and the inner wall of said cap in a state where said elastic washer is not assembled in said casing, said inner clearance being larger than said outer clearance; wherein a difference between said inner and outer clearances generally corresponds to at least a radial displacement amount of the inner wall of said cap.

7. A catalytic converter as claimed in claim 6, wherein the difference between said inner and outer clearances is not less than 0.5% of the diameter of the inner wall of said cap.

* * * * *